US005467045A

United States Patent [19]

Tanigawa

[11] Patent Number: 5,467,045

[45] Date of Patent: Nov. 14, 1995

[54] INTEGRATOR INCLUDING AN OFFSET ELIMINATING CIRCUIT AND CAPABLE OF OPERATING WITH LOW VOLTAGE

[75] Inventor: Hiroshi Tanigawa, Tsurugashima, Japan

[73] Assignee: Toko, Inc., Tokyo, Japan

[21] Appl. No.: 329,204

[22] Filed: Oct. 26, 1994

[30] Foreign Application Priority Data

Oct. 29, 1993 [JP] Japan ..... 5-294185

[51] Int. Cl.[6] ..... G06G 7/64

[52] U.S. Cl. ..... 327/336; 327/341; 327/345

[58] Field of Search ..... 327/336, 341, 327/345, 94, 96; 330/252, 254, 257, 258

[56] References Cited

U.S. PATENT DOCUMENTS

| | | | |
|---|---|---|---|
| 4,223,275 | 9/1980 | Den Brinker | 327/336 |
| 4,228,366 | 10/1980 | Hüttemann et al. | 327/336 |
| 4,300,102 | 11/1981 | Inoue | 330/254 |
| 4,902,984 | 2/1990 | Vinn et al. | 330/252 |
| 4,965,529 | 10/1990 | Laug | 330/255 |
| 5,184,088 | 2/1993 | Craft | 330/254 |
| 5,200,655 | 4/1993 | Feldt | 327/362 |
| 5,329,173 | 7/1994 | Murakami et al. | 327/362 |
| 5,365,191 | 11/1994 | Hayashi | 330/252 |

FOREIGN PATENT DOCUMENTS

| | | | |
|---|---|---|---|
| 60-235515 | 11/1985 | Japan | 330/257 |

*Primary Examiner*—Timothy P. Callahan
*Assistant Examiner*—Kenneth B. Wells

[57] ABSTRACT

A complete type integrator is disclosed which is designed such that the time-constant thereof can be controlled; wide input and output dynamic ranges can be achieved; operation with low power supply voltage is possible; and no offset voltage is generated. More specifically, the integrator comprises an amplifier circuit having a combination of a first and a second differential amplifier circuit (A1, A2) and connected to the input side of an integrator circuit; and an offset eliminating circuit connected to that portion of the amplifier circuit where the input signal (9) is applied. The offset eliminating circuit comprises a combination of a first, a second and a third current-mirror circuit (B1, B2, B3).

1 Claim, 2 Drawing Sheets

INTEGRATOR INCLUDING AN OFFSET ELIMINATING CIRCUIT AND CAPABLE OF OPERATING WITH LOW VOLTAGE

BACKGROUND OF THE INVENTION

1. Field of the Invention

The present invention relates to a complete type an integrator designed so as to have controllable time constant and wide input and output dynamic ranges and so as to be free from occurrence of offset.

2. Description of the Prior Art

Referring to FIG. 4 of the accompanying drawings, a circuit diagram of a conventional integrator is shown, the time constant of which can be controlled. In FIG. 4, diodes D10 and D11 are connected to the collectors of transistors Q20 and Q21 which constitute a differential transistor pair of a differential amplifier, respectively. Variable current sources S10 and S11 are connected to the emitters of the transistors Q20 and Q21 respectively, and a resistor R10, which defines the time constant of the integrator, is further connected between the emitters of these transistors.

A current-mirror circuit formed by transistors Q24 and Q25 and serving as an active load is connected to the collectors of transistors Q22 and Q23 which constitute a differential transistor pair of another differential amplifier, and a variable current source S12 is coupled to the connected emitters of the transistors Q22 and Q23. Output terminal 11 of the integrator is tied to the collector of the transistor Q23, and a capacitor C10 is connected between the output terminal 11 and the ground. As will be appreciated, a complete type integrator is formed by the capacitor C10 and the differential amplifier to which the capacitor C10 is connected. The time constant of the integrator can be controlled by changing current values of the variable current sources S10, S11 and S12.

Reference numeral 12 indicates a ground terminal; 8 a voltage source providing a bias voltage $V_{BA}$; 9 an input signal; and 10 a power supply terminal to which power supply voltage $V_{CC}$ is applied.

With such an integrator, input signal 9 superimposed upon the bias voltage $V_{BA}$ is applied to the base of the transistor Q20, and the bias voltage $V_{BA}$ is imparted to the base of the transistor Q21; thus, the input signal 9 is transformed to a current depending on the resistor R10, and outputted at the collectors of the transistors Q20 and Q21.

The thus obtained current results in a voltage drop at the diodes D10 and D11, so that a current corresponding to the voltage drop is caused to flow through the capacitor C10. In this way, integrator output is derived from the output terminal 11.

With the above-described integrator, the input signal 9 is applied directly to the base of the transistor Q20 constituting the differential pair; thus, it is necessary that the bias voltage $V_{BA}$ be higher than the base-emitter voltage of the transistor Q20. Further, to achieve wide input and output dynamic ranges for the input signal 9, it is also necessary that the bias voltage $V_{BA}$ be high as to correspond to the amplitude of the input signal 9.

Thus, with the above-described conventional circuit arrangement, the power supply voltage $V_{CC}$ for operating the differential amplifier circuit should be high. Disadvantageously, therefore, it cannot be operated with low power supply voltage $V_{CC}$.

In the case where each of the variable current sources S10, S11 and S12 is constituted by a current-mirror circuit comprising two transistors, it is required that tile power supply voltage for this integrator be as high as at least 1.5 V.

This voltage value is a sum of tile forward voltage $V_F$ (0.7 V) of the diode D11, the base-emitter voltage $V_{BE}$ (0.7 V) of the transistor Q23, and tile collector-emitter saturation voltage $V_{CES}$ (0.1 V) of tile load-side transistor constituting the variable current source S12.

Another problem is such that at the output terminal 11, an offset current is likely to appear which results from the base current of the transistors Q24 and Q25 which serve an active load circuit.

SUMMARY OF THE INVENTION

Accordingly, it is an object of the present invention to provide a complete type integrator which is designed so that the time constant thereof can be controlled; wide input and output dynamic ranges can be achieved; operation with a low power supply voltage is possible; and no offset is caused to occur.

The integrator according to the present invention comprises a grounded-emitter type integrator circuit; an amplifier circuit connected to the input side of the integrator circuit; and an offset eliminating circuit connected to the amplifier circuit. The amplifier circuit comprises a combination of a first and a second differential amplifier circuit each having a current-mirror circuit connected thereto as load, and is arranged such that bias current is variable. One of the transistors constituting the differential transistor pair of the first differential amplifier circuit is diode-connected. An input signal is imparted via resistor to the base of the diode-connected transistor and the base of one of the transistors constituting the differential transistor pair of the second differential amplifier circuit. Bias voltage is applied to the base of the other transistor constituting the differential transistor pair of each of the first and second differential amplifier circuits. The output terminal of the second differential amplifier circuit is coupled to the integrator circuit. The offset eliminating circuit comprises a first and a second current-mirror circuit connected in cascade and as load with each other, and a third current-mirror circuit having a plurality of transistors connected in base-common form to the transistors of the first current-mirror circuit and having the emitters thereof connected to a connection point between a constant current source and the transistor which has the bias voltage applied to its base thereof. One of the load-side transistors of the third current-mirror circuit is connected to the base of the diode-connected transistor of the first differential amplifier circuit.

Other objects, features and advantages of the present invention will become apparent from the ensuing description taken in conjunction with the accompanying drawings.

DESCRIPTION OF THE PREFERRED EMBODIMENTS

Figure 1:
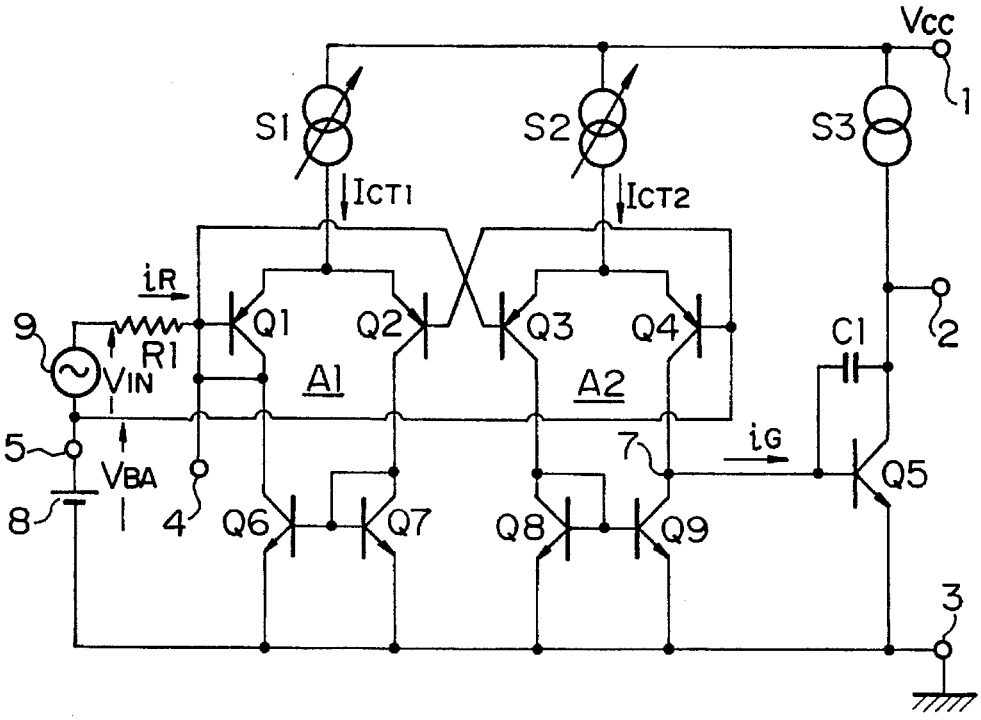
FIG. 1 is a circuit diagram showing the integrator according to an embodiment of the present invention.
Figure 2:
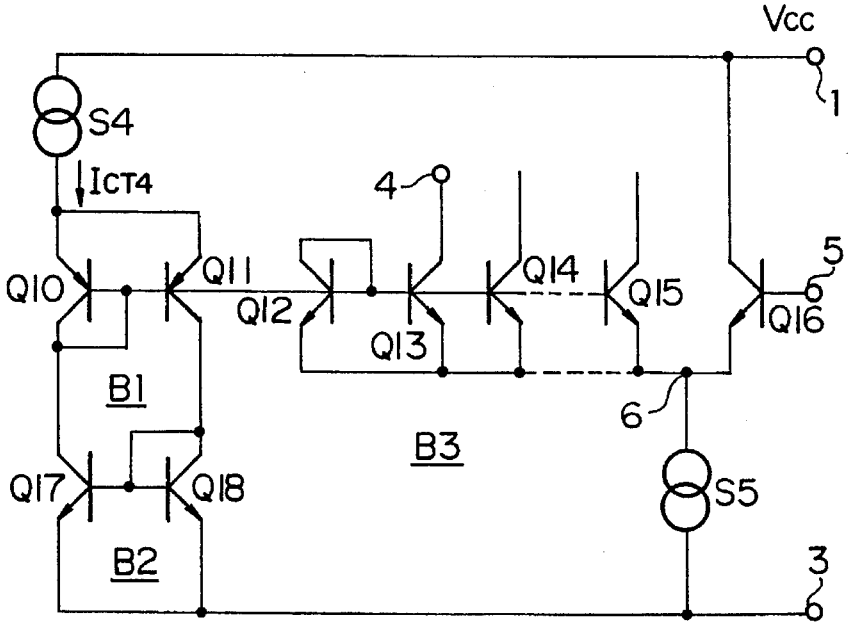
FIG. 2 is a circuit diagram of an offset eliminating circuit connected to the integrator of FIG. 1.

The integrator according to an embodiment of the present invention will now be described with reference to FIGS. 1 and 2. FIG. 1 is a circuit diagram showing an integrator circuit an amplifier circuit connected to the input of the integrator circuit. FIG. 2 is a circuit diagram showing an offset eliminating circuit for eliminating offset of the amplifier circuit.

Referring to FIG. 1, transistors Q1 and Q2 constitute a differential transistor pair of a first differential amplifier circuit A1, and have the emitters thereof connected with each other and to a variable current source, the collectors thereof being coupled to a ground terminal 3 through a current-mirror circuit comprising transistors Q6 and Q7. The variable current source S1 is connected to power supply terminal 1.

The emitters of transistors Q3 and Q4, constituting a differential transistor pair of a second differential amplifier circuit A2, are connected to each other and to a variable current source S2, the collectors thereof being coupled to a ground terminal 3 through a current-mirror circuit comprising transistors Q8 and Q9. The variable current source S2 is connected to the power supply terminal 1.

Input signal 9, superimposed upon bias voltage $V_{BA}$, is imparted to the bases of the transistors Q1 and Q3 through a resistor R1, and bias voltage $V_{BA}$ is applied to the bases of the transistors Q2 and Q4. A terminal connected to the base of the transistor Q1 is indicated at 4; a voltage source from which the bias voltage $V_{BA}$ is derived is denoted at 8; and a terminal connected to the voltage source 8 is shown at 5.

The first differential amplifier circuit A1 serves as a transconductance amplifier adapted to convert a voltage input to a current output, wherein tile collector of the transistor Q1 from which tile output is taken is connected to the base of tile transistor Q1 which is an inverting input terminal, and to which the input signal 9 is imparted through the resistor R1, so that the output is fed back thereto.

The differential amplifier A2 also serves as a transconductance amplifier in which the input signal 9 is imparted via tile resistor R1 to the base of the transistor Q3 which is a non-inverting input terminal.

Such a combination of the two differential amplifier circuits, each of which is a transconductance amplifier, results in a single amplifier circuit which is also a transconductance amplifier arranged such that the transconductance thereof is variable depending on bias current.

By changing the current values of the variable current sources S1 and S2, which supply bias currents to the first and second differential amplifier circuits A1 and A2, the transconductance of the amplifier circuit is changed, thereby making it possible to control the gain of the current which is derived as tile output of the amplifier circuit from connection point 7 between the transistors Q4 and Q9, as described hereinafter.

Transistor Q5 has a capacitor C1 connected between the base and the collector thereof, the collector thereof being connected to the power supply terminal 1 through a constant-current source S3, tile omitter thereof being tied to the ground terminal 3. Thus, the transistor Q5 constitutes a common-emitter type complete integrator. The output of the input side amplifier circuit is applied to the base of the transistor Q5, and output of the integrator circuit, i.e., the output of the integrator, is derived from the collector thereof.

The time-constant of the integrator output is controlled by changing the gain of the current obtained as output of the above-mentioned amplifier circuit in accordance with bias current.

FIG. 2 is a circuit diagram of an offset eliminating circuit for eliminating offset which tends to occur at the base of the transistor Q1 which serves as the input terminal of the amplifier circuit.

This offset eliminating circuit is mainly constituted by a first current-mirror circuit B1 comprising transistors Q1O and Q11; a second current-mirror circuit B2 comprising transistors Q17 and Q18; a third current-mirror circuit B3 comprising transistors Q12, Q13, Q14 and Q15; and a transistor Q16 which is supplied at its base with bias voltage $V_{BA}$ from terminal 5.

The first current-mirror circuit B1 is connected via a constant-current source S4 to tile power supply terminal 1, and the second current mirror circuit B2 is connected to the ground terminal 3. Further, tile first and second current-mirror circuits B1 and B2 are connected in cascade with each other so as to serve as load for each other.

The transistors of the third current-mirror circuit B3 have their bases connected in common with the bases of the transistors of the first current-mirror circuit B1, and also have their emitters connected to connection point 6 between the constant-current source S5 and the emitter of the transistor Q16. The collector of the load-side transistor Q13 is connected via terminal 4 to the base of the transistor Q1 of the amplifier circuit.

Ordinarily. the current sources S1 to S5 provided in the circuits of FIGS. 1 and 2 are constituted by current-mirror circuits.

Transfer functions will now be derived for the purpose of explaining the operation of the integrator having the above-described construction.

Assuming that the current of the variable current source S1 is $I_{CT1}$, the input current which flows through the resistor R1 depending on tile input signal 9 is $i_R$, the current flowing through the emitter of the transistor Q1 is $I_1$, and the current flowing through the emitter of the transistor Q2 is $I_2$, the following equations (1) and (2) will hold true:

$$I_1=(I_{CT1}-i_R)/2 \quad (1)$$

$$I_2=(I_{CT1}+i_R)/2 \quad (2)$$

The voltage difference $\Delta V_{BE}$ between the base-emitter voltage $V_{BE1}$ of the transistor Q1 and the base-emitter voltage $V_{BE2}$ of the transistor Q2 is given by the following expression:

$$\begin{aligned}\Delta V_{BE} &= V_{BE2}-V_{BE1}=V_T\,\mathrm{LN}(I_2/I_S)-V_T\,\mathrm{Ln}(I_1/I_S) \\ &= V_T\,\mathrm{Ln}(I_2/I_1) \\ &= V_T\,\mathrm{Ln}\{(I_{CT1}+i_R)/(I_{CT1}-i_R)\}\end{aligned} \quad (3)$$

where $V_T$ is thermoelectromotive force at absolute temperature T, and $I_S$ is reverse saturation current.

Further, assuming that tile current of the variable current source S2 is $I_{CT2}$, the current flowing through the emitter of the transistor Q3 is $I_3$, the current flowing through the emitter of the transistor Q4 is $I_4$, and the current derived as output from connection point 7, i.e., output terminal of the amplifier circuit is $i_G$, then the following equations (4) and (5) will hold true:

$$I_3=(I_{CT2}-i_G)/2 \quad (4)$$

$$I4=(ICT2+iG)/2 \quad (5)$$

The voltage difference ΔVBE between the base-emitter voltage VBE3 of the transistor Q3 and the base-emitter voltage VBE4 of the transistor Q4 is given by the following expression (6):

$$\begin{aligned}\Delta V_{BE} &= V_{BE4}-V_{BE3}=V_T\,\mathrm{LN}(I_4/I_S)-V_T\,\mathrm{Ln}(I_3/I_S) \quad (6)\\ &= V_T\,\mathrm{Ln}(I_4/I_3)\\ &= V_T\,\mathrm{Ln}\{(I_{CT2}+i_G)/(I_{CT2}-i_G)\}\end{aligned}$$

Thus, the following equation (7) holds true:

$$(I_{CT2}+i_G)/(I_{CT2}-i_G)=(I_{CT1}+i_R)/(I_{CT1}-i_R) \quad (7)$$

As will be appreciated, the current iG is represented by the following equation (8):

$$iG=ICT2\cdot iR/ICT1 \quad (8)$$

As will be noted from equation (8), the input current iR, is gain-controlled in accordance with the current ICT1 of the variable current source S1 and current ICT2 of the variable current source S2, and inputted as the current iG to the base of the transistor Q5 constituting the integrator circuit.

Assuming that input voltage applied to the resistor R1 in accordance with the input signal 9 is $V_{IN}$, the input current iR is given by the following equation (9):

$$\begin{aligned}i_R &= \{(V_{IN}+V_{BA})-(V_{BA}+V_{BE2}-V_{BE1})\}/R1 \quad (9)\\ &= (V_{IN}{}^{\prime}R1)-[\{V_T\,\mathrm{Ln}(I_{CT1}+i_R)/(I_{CT1}-i_R)\}/R1]\\ &\approx V_{IN}/R_1\end{aligned}$$

where R1 represents the resistance value for the resistor R1

Output voltage VOUT derived from output terminal 2 is given by tile following equation (10):

$$V_{OUT}=-(1/C1)\cdot\int i_G\,dt=-(I_{CT2}/I_{CT1})\cdot(1/C1)\cdot \quad (10)$$
$$\int i_R\,dt=-(I_{CT2}/I_{CT1})\cdot(1/C1\cdot R1)\cdot\int V_{IN}\,dt$$

where C1 represents the capacitance value for the capacitor C1.

Thus, the transfer function is given by equation (11), from which it will be appreciated that a complete type integrator is achieved such that by changing ICT1 and ICT2, i.e., bias currents for the amplifier circuit, the time constant can be changed.

$$(V_{OUT}/V_{IN})=-(I_{CT2}/I_{CT1})\cdot(1/C1\cdot R1)\cdot(1/s) \quad (11)$$

where s is jω.

Offset which tends to occur with an integrator in which the amplifier circuit is connected to the input of the integrator circuit as shown in FIG. 1, will now be considered.

Assuming that tile emitter and base currents of the transistor Q2 are I2 and I2 respectively, the collector current IC2 thereof is given by the following equation (12):

$$IC2=I231\ IB2 \quad (12)$$

Assuming that the base currents of the transistors Q6 and Q7 are IB6 and IB7 respectively, and that the collector currents thereof are IC6 and IC7 respectively, the following equation (13) holds:

$$\begin{aligned}I_{C6} = I_{C7} &= I_{C2}-(I_{B6}+I_{B7}) \quad (13)\\ &= I_2-I_{B2}-I_{B6}-I_{B7}\end{aligned}$$

Assuming that the emitter current of the transistor Q1 is I1 and that the base current of the transistor Q3 is IB3, current IOST, causing offset to occur and flowing through the resistor R1 in the opposite direction to the input current iR, is given by the following equation (14):

$$\begin{aligned}I_{OST} &= I_1-I_{C6}+I_{B3} \quad (14)\\ &= I_1-I_2+I_{B2}+I_{B6}+I_{B7}+I_{B3}\end{aligned}$$

Referring to FIG. 2, the offset eliminating circuit for eliminating the current IOST, which causes such offset to occur, will now be described. Assuming that the emitter and base currents of the transistor Ql of the first current-mirror circuit B1 are I11 and IB11 respectively, the collector current IC11 thereof is given by the following equation (15):

$$IC11=I11-IB11 \quad (15)$$

Assuming that the base currents of the transistors Q18 and Q17 of the second current-mirror circuit B2 are IB18 and IB17 respectively, the collector currents IC18 and IC17 of the transistors Q18 and Q17 are given by the following equation (16):

$$\begin{aligned}I_{C18} &= I_{C17}=I_{C11}-(I_{B18}+I_{B17}) \quad (16)\\ &= I_{11}-I_{B11}-I_{B18}-I_{B17}\end{aligned}$$

Assuming that the emitter current of the transistor Q10 of the first the current-mirror circuit B1 is I10, current I12 flowing in the diode-connected transistor Q12 of the third current-mirror circuit B3, given by the following equation (17):

$$\begin{aligned}I_{12} &= I_{10}-I_{C17}+I_{B11} \quad (17)\\ &= I_{10}-I_{11}+I_{B11}+I_{B17}+I_{B18}+I_{B11}\end{aligned}$$

Assuming that the current ICT1 of the variable current source S1 is equal to the current ICT2 of variable current source S2, equation (17) will be compared with the equation (14).

Further assuming that the relationship among the current ICT1, the current ICT2, and the current ICT4 of the constant-current source S4 is represented by equation (18), equations (19) and (20) will hold true:

$$ICT4=(ICT1+ICT2)/2 \quad (18)$$

$$I1=I10 \quad (19)$$

$$I2=I3=I11 \quad (20)$$

Thus, the following equations (21) to (23) will also hold true:

$$IB2=IB3=IB11 \quad (21)$$

$$IB6=IB17 \quad (22)$$

$$IB7=IB18 \quad (23)$$

From the above discussion, it will be appreciated that the equation (17) is equal to the equation (14).

Obviously, current flowing through the transistor Q12 is caused to flow as mirror current through the transistor Q13 so that current IOST which tends to cause offset to occur is eliminated by connecting the collector of the transistor Q13 via terminal 4 to the base of the transistor Q1.

Furthermore, with this offset eliminating circuit, the collector-emitter voltage VCE of the transistors Q1, Q4, QlO, the collector-emitter voltage VCE of the transistors Q2, Q3, Qll, the collector-emitter voltage VCE of the transistors Q6, Q9, Q17, and the collector-emitter voltage VCE of the transistors Q7, Q8, Q18 always remain equal to each other irrespective of variations in the power supply voltage VCC; thus, no influence of "early effect" will occur.

It is not necessary that each integrator have its own individual offset eliminator circuit; it is possible that with a plurality of load-side transistors being incorporated in the third current-mirror circuit, a single offset eliminating circuit may be used in common for a plurality of integrators by connecting the collectors of the transistors Q14 and Q15. for example, to another integrator.

This is convenient when constructing an active filter or the like by using a plurality of integrators.

As can be appreciated from the above explanation, with the present integrator, wherein the amplifier circuit, consisting of a combination of two differential amplifier circuits, and the offset eliminating circuit are connected to the input side of the integrator circuit, it is possible to cause the time-constant of the integrator to be changed in accordance with tile bias current of the amplifier circuit.

The input dynamic range of tile present integrator is given by the following expression (24) when the relationship between the bias voltage VBA and the power supply voltage VCC is such that VBA=VCC/2:

$$(VIN/R1)<ICT1 \quad (24)$$

This is due to the fact that by establishing the above relationship (24), the input current $i_R$ is caused to be lower than the current ICT1, i.e., bias current and thus the transistors Q1, Q2, Q6, Q7 are not saturated.

Advantageously, the input dynamic range can be determined by the resistor R1 and current ICT1, irrespective of the magnitude of the input voltage VIN. Thus, there is no necessity that tile bias voltage VBA be made as high as in the prior art even when tile input voltage VIN is high.

Assuming that tile collector-emitter saturation voltage of the load-side transistor of tile current-mirror circuit constituting the variable current source S3 and that of the transistor Q5 are VCES respectively, the output dynamic range will be given by the following expression (25) when VBA=VCC/2:

$$VCC-2VCES \quad (25)$$

This is because of the fact that the integrator circuit provided at the output side of the integrator is of the emitter-grounded type so that output is derived from the collector.

Another requirement is such that the power supply voltage VCC meets the following relationship (26):

$$VCC>VBE+2VCES \quad (26)$$

The power supply voltage VCC is a voltage necessary to turn on the transistors of the first and second differential amplifier circuits. It will be apparent that the above relationship (26) will be established, in view of the voltage drop which occurs in the current path from the power source terminal 1 to the ground terminal 3, say i.e., the base-emitter voltage VBE of the transistor Q1, the base-emitter voltage VBE of the transistor Q6, and the collector-emitter saturation voltage VCES of tile load-side transistor constituting the variable current source S1.

For example, assuming that the base-emitter voltage VBE is 0.7 V and that the collector-emitter saturation voltage VCES is 0.1 V. Then, the power supply voltage VCC may be about 0.9 V at a minimum.

Figure 3:
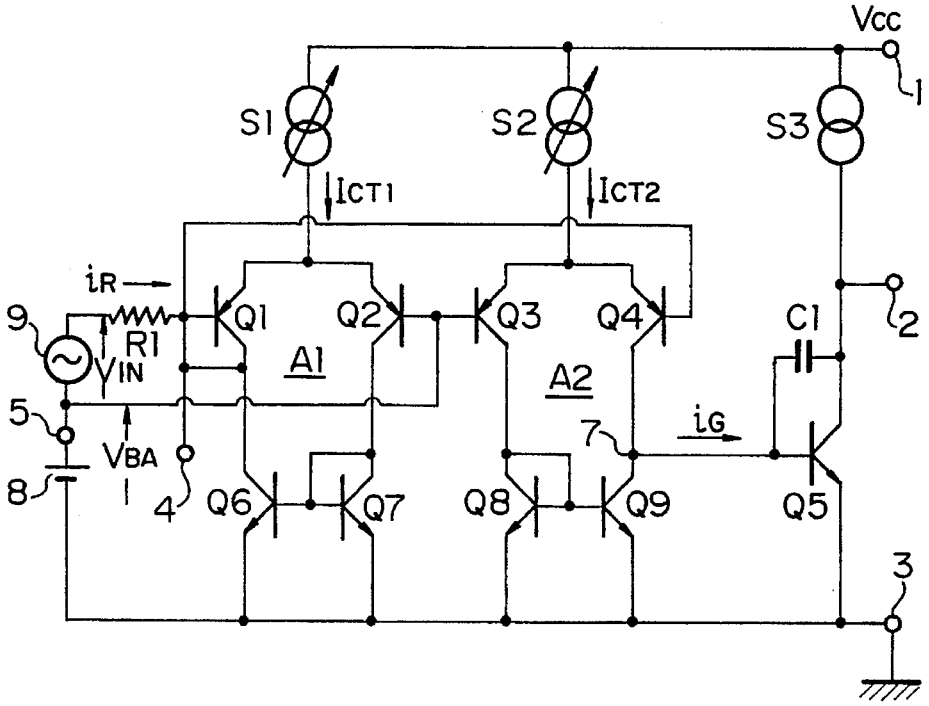
FIG. 3 is a circuit diagram showing the integrator according to a second embodiment of the present invention.
Figure 4:
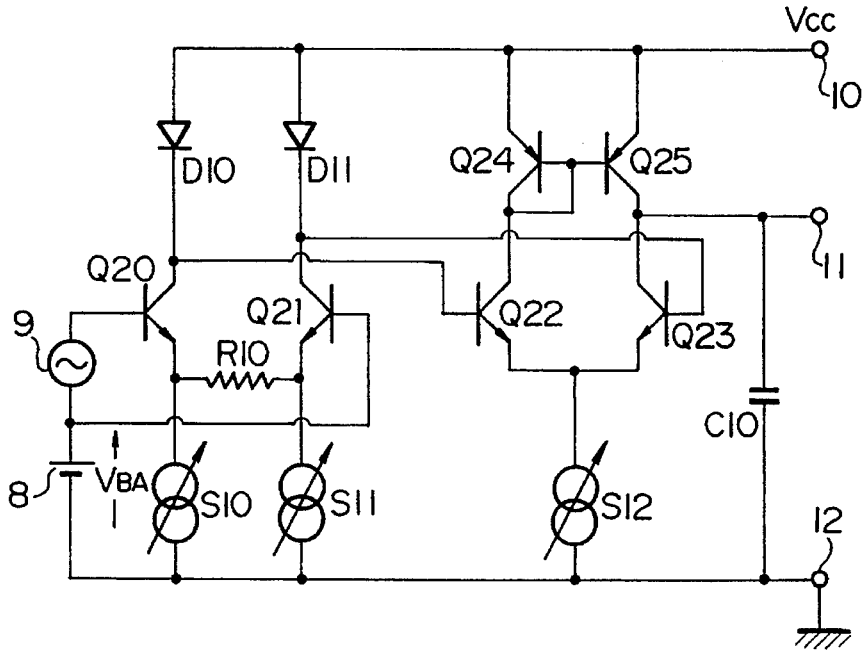
FIG. 4 PRIOR ART
FIG. 4 is a circuit diagram showing a conventional integrator.

FIG. 3 is tile circuit diagram showing the integrator according to another embodiment of the present invention, wherein parts corresponding to FIG. 1 are indicated by like reference symbols.

The embodiment of FIG. 3 is similar in arrangement and operation to FIG. 1. except that the input terminal for input signal 9 in the second differential amplifier circuit A2 is the base of transistor Q4 which serves as a non-inverting input terminal. With the integrator of FIG. 3, it will be noted that the minus sign in tile transfer function given by the equation (11) is eliminated.

As described above, in tile integrator according to the present invention, an amplifier circuit comprising a combination of two differential amplifiers, and an offset eliminating circuit are connected to the input side of an emitter-grounded type integrator circuit. The amplifier circuit is constituted by a transconductance amplifier; and by changing bias current of the amplifier, the time-constant of the integrator can be controlled.

An input signal is imparted to the amplifier circuit through a resistor, so that the input dynamic range of the integrator can be determined by the resistance value for the resistor and the bias current for the amplifier circuit and thus can be set up to be wide irrespective of the voltage value of the input signal.

Another advantage is that the output dynamic range of the integrator can be widened by virtue of the fact that the integrator circuit provided at the output side of the integrator is emitter-grounded.

A further advantage is that since the power supply voltage can be made to be low, as mentioned above, an integrator which operates with a low voltage, can be provided in accordance with the present invention.

A still further advantage is that the output of the integrator can be maintained accurately since no offset is caused to occur as in the prior-art integrator.

While the present invention has been illustrated and described with respect to specific embodiments thereof, it is to be understood that the present invention is by no means limited thereto but encompasses all changes and modifications which will become possible within the scope of the appended claims.

I claim:

1. An integrator comprising an emitter-grounded type integrator circuit comprising a transistor having the emitter thereof grounded and having a capacitor connected between the base and collector thereof, an amplifier circuit connected to the input side of said integrator circuit, and an offset eliminating circuit connected to said amplifier circuit, wherein said amplifier circuit comprises a first and a second differential amplifier circuit each of which comprises a differential transistor pair and includes a variable current source connected to common-connected emitters of the transistors of the differential transistor pair and a current-mirror circuit connected thereto as a load; one of the transistors constituting the differential transistor pair of said first differential amplifier circuit is diode-connected; an input signal super-imposed upon the bias voltage is imparted through a resistor to the base of one of the transistors constituting the differential transistor pair of said second amplifier circuit; said bias voltage is applied to the bases of the remaining transistors constituting said differential pairs of said first and second differential amplifier circuits; said offset eliminating circuit comprises a first and a second current-mirror circuit connected in cascade so as to serve as load for each other, and a third current-mirror circuit comprising a plurality of transistors which are connected in a base-common fashion to the transistors of said first current-mirror circuits and have emitters thereof connected to a current source providing a constant current and to the emitters of said transistors to which said bias voltage is applied at the bases thereof; and one of the output transistors of said third current-mirror circuit is connected to the base of said diode-connected transistor of said first differential amplifier circuit.

* * * * *